US007011067B2

(12) United States Patent
Savel, III et al.

(10) Patent No.: US 7,011,067 B2
(45) Date of Patent: Mar. 14, 2006

(54) CHROME PLATED ENGINE VALVE

(75) Inventors: Frank J. Savel, III, Chardon, OH (US); Robert C. McLaren, Willoughby Hills, OH (US); Doug Mellema, Painesville, OH (US)

(73) Assignee: TRW, Lyndhurst, OH (US)

( * ) Notice: Subject to any disclaimer, the term of this patent is extended or adjusted under 35 U.S.C. 154(b) by 0 days.

(21) Appl. No.: 10/223,182

(22) Filed: Aug. 19, 2002

(65) Prior Publication Data

US 2004/0031461 A1 Feb. 19, 2004

(51) Int. Cl.
*F02N 3/00* (2006.01)

(52) U.S. Cl. ..... 123/188.3

(58) Field of Classification Search ..... 123/188.1, 123/188.3, 188.2; 29/888.452
See application file for complete search history.

(56) References Cited

U.S. PATENT DOCUMENTS 1,731,202 A * 10/1929 Phillips ..... 123/188.3
1,956,014 A * 4/1934 Fink et al. ..... 123/188.3
2,627,259 A * 2/1953 Wood et al. ..... 123/188.3
4,092,226 A 5/1978 Laing et al.
4,804,446 A 2/1989 Lashmore et al.
5,040,501 A * 8/1991 Lemelson ..... 123/188.3
5,190,002 A 3/1993 Wietig
5,271,823 A 12/1993 Schachameyer et al.
5,328,527 A * 7/1994 Kurup et al. ..... 29/888.452
5,647,967 A 7/1997 Murase et al.
6,309,916 B1 10/2001 Crowley et al.

FOREIGN PATENT DOCUMENTS

EP 1150004 A2 10/2001

OTHER PUBLICATIONS

J.K. Dennis, et al., "Nickel and Chromium Plating", 3rd Edition, pp. 235-239 (1993).
SAE International, SAE AMS 2438A, Plating, Chromium, Thin, Hard, Dense Deposit, 9 pgs., Oct. 1998.
"Armology TDC", pp. 1-2, hhttp//www.armdoyil.com/tdc-html, Jun. 2002.
"The Armology Corp." pp. 1-3, hhttp//www.armdoyil.com/are.html, Jun. 2002.
"Armology" pp. 2-4, hhttp/www.armology-wpa.com, Jun. 2002.
Satas, "Coatings Technology Handbook", pp. 201-213, (1991).
"Hi-Tec Plating, Inc." p. 1,hhttp/www.hitecplating.com/tdcspec.html, Dec. 1999.

* cited by examiner

*Primary Examiner*—Noah P. Kamen
(74) *Attorney, Agent, or Firm*—Tarrolli, Sundheim, Covell & Tummino L.L.P.

(57) ABSTRACT

A valve (10) for use in an internal combustion engine comprises a base metal. The base metal is covered with a thin, dense chromium coating.

4 Claims, 4 Drawing Sheets

CHROME PLATED ENGINE VALVE

FIELD OF THE INVENTION

The present invention relates to a valve for use in an internal combustion engine, and particularly relates to a valve plated with a chromium coating for use in an internal combustion engine.

BACKGROUND OF THE INVENTION

A valve for use in an automobile internal combustion engine includes a valve stem that interconnects a valve head and a valve tip. The valve stem reciprocates at high speeds and high temperatures within a valve guide. The valve stem can be subjected to frictional wear such that galling or abrasion can occur between the valve stem and the valve guide. "Galling" is defined as an action approaching cold welding that causes adjacent surfaces to have a aggravated by increased engine speeds and operating temperatures as well as decreased availability of lubrication to the valve stem.

Valve stems are typically plated with a chromium coating to decrease the frictional wear between the valve stem and the valve guide. Chromium coatings have a lower coefficient of friction than the base material of the valve. When a chromium coating is applied to a valve stem, it is generally hard and includes micro-cracks. The micro-cracks reduce the residual tensile stress within the chromium coating and help support an oil film along the valve stem.

An engine valve is plated with chromium using a plating apparatus that can selectively plate the valve stem without plating the valve head and valve tip. Examples of plating apparatuses that can be used to selectively plate the valve stem are a rack type plater and a finger type plater.

The valve head and the valve tip are not plated with a chromium coating because a chromium coating tends to reduce the fatigue life of the base material that is plated. Accordingly, a chromium coating is limited to the valve stem in order to minimize the adverse affects of the chromium coating.

SUMMARY OF THE INVENTION

The present invention relates to a valve for use in an internal combustion engine. The valve comprises a base metal. The base metal is covered with a thin, dense chromium coating.

In accordance with one aspect of the present invention, the valve includes a valve head, a valve tip, and a valve stem that interconnects the valve head and the valve tip. The thin, dense chromium coating completely covers the valve head, the valve tip, and the valve stem.

BRIEF DESCRIPTION OF THE DRAWINGS

The foregoing and other features of the invention will become more apparent to one skilled in the art upon consideration of the following description of the invention and the accompanying drawings in which.

DESCRIPTION

The present invention relates to an engine valve, such as an exhaust or intake valve, for an internal combustion engine.

Figure 1:
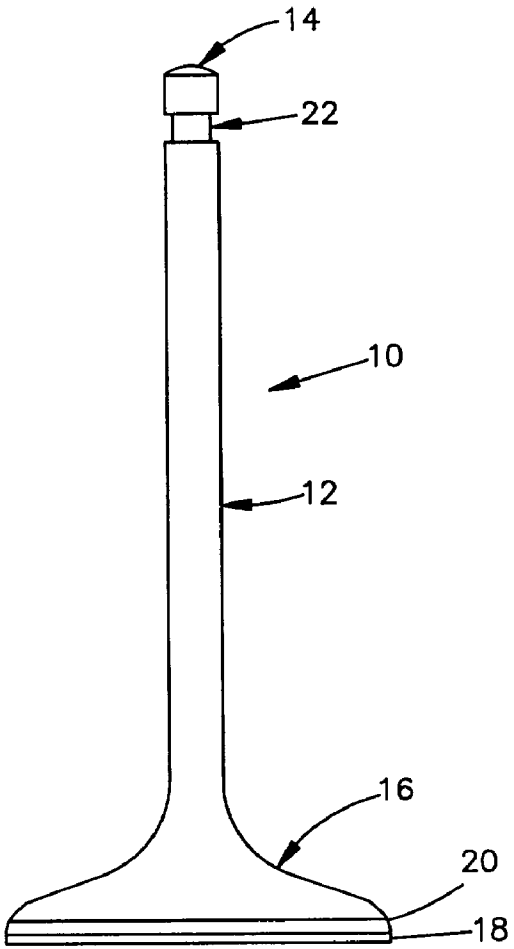
FIG. 1 is a schematic illustration of a valve for an internal combustion engine in accordance with the present invention.

FIG. 1 is a schematic illustration of an engine valve 10 in accordance with the present invention. The engine valve 10 comprises a rod-shaped valve stem 12 that interconnects a valve tip 14 and a valve head 16. The valve stem 12 can be formed in one-piece with the valve head 16 and the valve tip 14. The valve head 16 has a generally disc shape and includes an annular outer surface 18. The annular outer surface 18 is beveled to form an annular face 20. The valve stem 12 also includes an annular grove 22 adjacent the valve tip 14.

Figure 2:
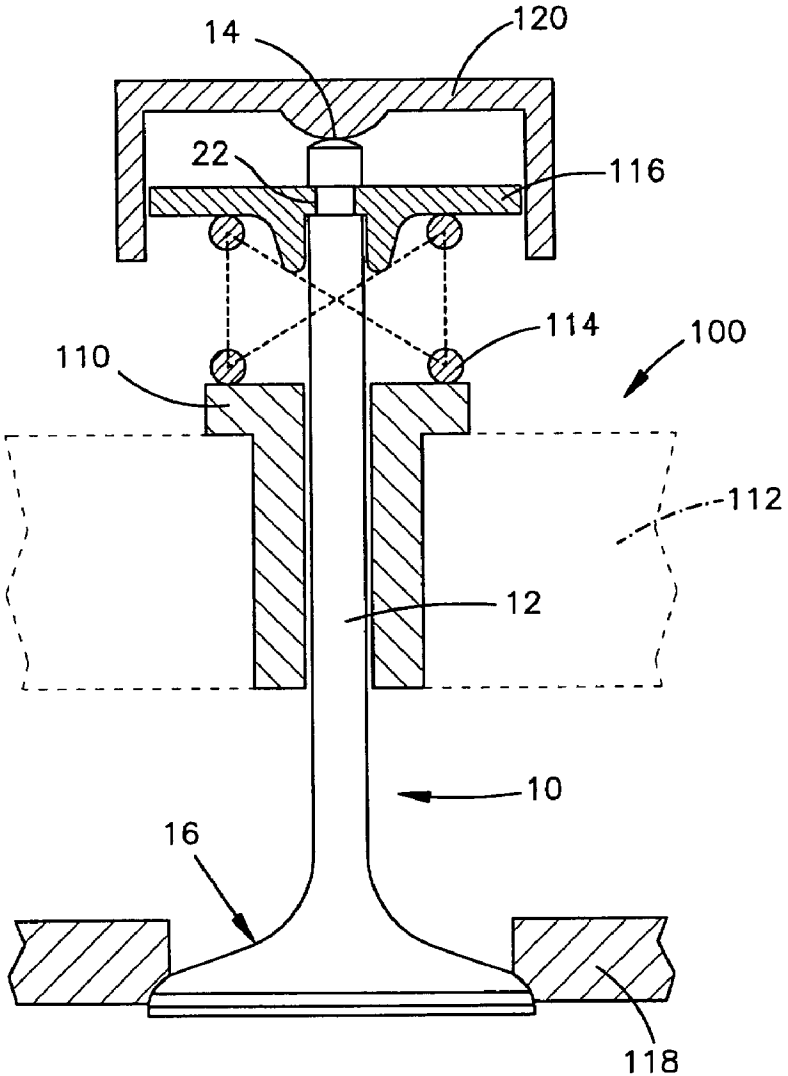
FIG. 2 is sectional view of a valve mechanism in which the valve of FIG. 1 is used.

FIG. 2 is a cross-section view of a valve mechanism 100 for an internal combustion engine in which the valve 10 can be used. The valve 10 is positioned within a valve guide 110 of an engine block 112. The valve stem 12 extends through the valve guide. 110 and is operative to move reciprocally relative to the valve guide 110. Typical clearance between the valve stem 12 and the valve guide 110 is from about 0.0008 inches to about 0.0030 inches.

A valve spring 114 extends about the valve stem 12. The valve spring 114 engages a spring retainer 116 that is secured in the groove 22. The spring retainer 116 transmits pressure from the spring 114 to the valve head 16 to press the valve 10 to a closed position against a valve seat 118.

A valve tappet 120 engages the valve tip 14. The valve tappet 120 rides against a cam (not shown). The cam includes a lobe that is provided on a cam shaft. As the lobe moves against the valve tappet 120, the valve tappet 120 is displaced. Displacement of the valve tappet 120 causes the valve head to be displaced from the valve seat 18 within the engine cylinder to an open position. When the lobe of the cam moves away from the valve tappet 120, pressure from the spring 114 forces the valve head 16 to reseat. At the same time, the valve tappet 120 is also forced by the spring 114 so that it remains in contact with the cam.

In accordance with the present invention, the valve 10 can be made from one or more metals. The metals can be selected according to whether the valve is an intake or an exhaust valve. Generally, a stainless steel can be used to form the exhaust valve, while a carbon steel can be used to form the intake valve. An example of a stainless steel that can be used to form the exhaust valve is AISI No. 21-2 PH stainless steel. An example of a carbon steel that can form the intake valve is AISI No. 1541 carbon steel.

Other metals, which are well known in the art for valve formation can be used to form the valve or at least a portion of the valve of the present invention. For example AISI No.

4140 steel can be used to form a valve tip for a valve in accordance with the present invention.

The valve 10 further includes a thin, dense chromium coating that is plated on the surface of the valve. By "thin, dense chromium coating", it is meant a micro-nodular, substantially crack-free layer of chromium that has a thickness less than about 0.001 inches and a Rockwell C hardness ($R_c$) greater than 70. The thin, dense chromium coating preferably complies with SAE international AMS 2438a, which is hereby incorporated by reference.

The thin, dense chromium coating can be plated on the valve so that the thin, dense chromium coating substantially covers the valve stem. Unlike prior art hard chromium coatings, the thin, dense chromium coating of the present invention can be plated on the valve head and the valve tip in addition to the valve stem so that the valve is substantially covered with the thin, dense chromium coating. Surprisingly, it was found that the fatigue life and corrosion life of the base metal of the valve head and the valve tip are substantially increased when the valve head and valve tip are plated with the thin, dense chromium coating. Preferably, the valve is completely covered with the thin, dense chromium coating.

The thickness of the thin, dense chromium coating is preferably in the range of about 0.000030 inches (30 millionths) to about 0.0007 inches. More preferably, the thickness of the thin, dense chromium coating is about 0.000030 inches (30 millionths) to about 0.0003 inches.

Prior to plating with the thin, dense chromium, the surface of the valve is machined so that it has a surface finish of about 15$\mu$ inches or less, as measured in accordance with ANSI B46.1. After plating with the thin, dense chromium, the surface of the valve has a surface finish that is less rough than the finish before plating, as measured in accordance with ANSI B46.1. This improvement in surface finish is in contrast to prior are hard chromium coatings, which tend to decrease the quality of the surface finish.

The thin, dense chromium coating can be plated on the valve using a commercially available thin, dense chromium plating process. An example of a preferred thin, dense chromium plating process is the TDC-1 process, which is commercially available from Hi-Tec Plating, Inc., 219 Hitec Rd. Seneca, S.C. 29678.

The TDC-1 process is a chromium electroplating process that produces a micro-nodular, crack-free, thin, dense chromium coating. The thin, dense chromium coating produced by the TDC-1 process has a bi-modal hardness and a bi-modal elastic modulus on a nano-scale. By "bi-modal" it is meant that the thin dense chromium coating exhibits two distinct hardnesses and two distinct elastic moduli when tested with a nano-indentation system. Both hardness values for the thin dense chromium coating produced by the TDC-1 process are greater than about 70, based on a Rockwell C hardness. Both elastic modulus values for the thin, dense chromium coating produced by the TDC-1 process are greater than about 280 giga-pascals (GPa) (Mega-pounds per square inches) (MSI). The TDC-1 process can apply a thin, dense chromium coating in a thickness range from 0.00002 inches (20 millionths) to 0.000250 inches (250 millionths). The thin, dense chromium coating plated by the TDC-1 process has a whitish-gray, matte finish.

The TDC-1 process is not recommended for use on aluminum, magnesium, or titanium. It is, however, compatible with all ferrous metals, and in particular, the dense, high-hardness metals used to make valves for internal combustion engines.

Another, process that can be used to plate a thin, dense chromium coating in accordance with the present invention is the ARMOLOY process, which is commercially available from franchised ARMOLOY dealers. A listing of ARMOLOY dealers can be obtained from the Armoloy Company of Philadelphia, 1105 Miller Ave, Croydon, Pa. 19021.

The TDC-1 process and the ARMOLOY process typically use a rack type plater or a finger type plater to plate the valve with the thin, dense chromium coating. A barrel type plater can also be used to plate the valve with the thin, dense chromium coating. It is advantageous to use a barrel type plater to plate the valve with the thin, dense chromium coating because a barrel type plater is more cost effective, does not require the fixturing of the valve within the plater, and plates the complete surface of the valve.

The following examples illustrate the present invention.

EXAMPLE 1

An exhaust valve and an intake valve for a General Motors 3.1 liter automobile engine were made in accordance with the present invention.

Both the exhaust valve and intake valve had a construction similar to FIG. 1. The exhaust valve was integrally forged from 1541 carbon steel. While the intake valve was integrally forged from 212 valve alloy steel. A wafer of 4140 steel was also attached to the tip of the exhaust valve by welding. Both the exhaust valve and the intake valve were machined so that they had a surface finish less than about 15$\mu$ inches, as measured in accordance with ANSI B46.1.

Both the exhaust valve and the engine valve were plated with a thin, dense chromium coating using the TDC-1 process from Hi-Tec Plating, Inc., 219 Hitec Rd. Seneca, S.C. 29678.

The thin, dense chromium (TDC) coatings plated on the exhaust and intake valve were both micro-nodular, crack-free, and conformed to AMS 2438a.

The exhaust valve and the intake valve were tested in a 3.1 liter General Motors engine for scuffing and durability.

Figure 3:
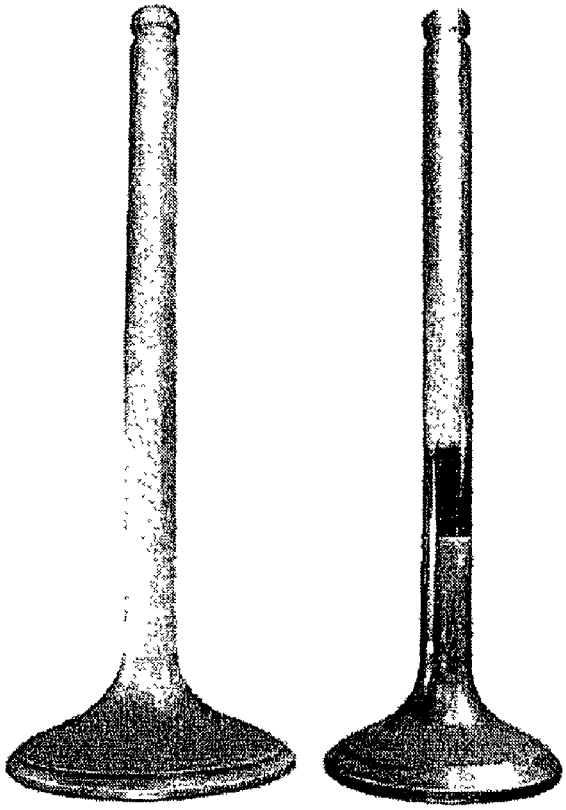
FIG. 3 is a picture showing the results of a scuff test performed on an exhaust valve and intake valve in accordance with the present invention.

The scuff test was performed by installing the exhaust valve and intake valve in the 3.1 liter GM engine and operating the engine for 9 hours. After 9 hours, the exhaust valve and intake valve were removed from the engine and visually inspected for wear. FIG. 3 shows that both the exhaust valve (left valve in FIG. 3) and intake valve (right valve in FIG. 3) exhibited no signs of corrosion and galling. The intake valve head portion and stem portion adjacent the head portion did show some color change, but this was within normal specifications.

Figure 4:
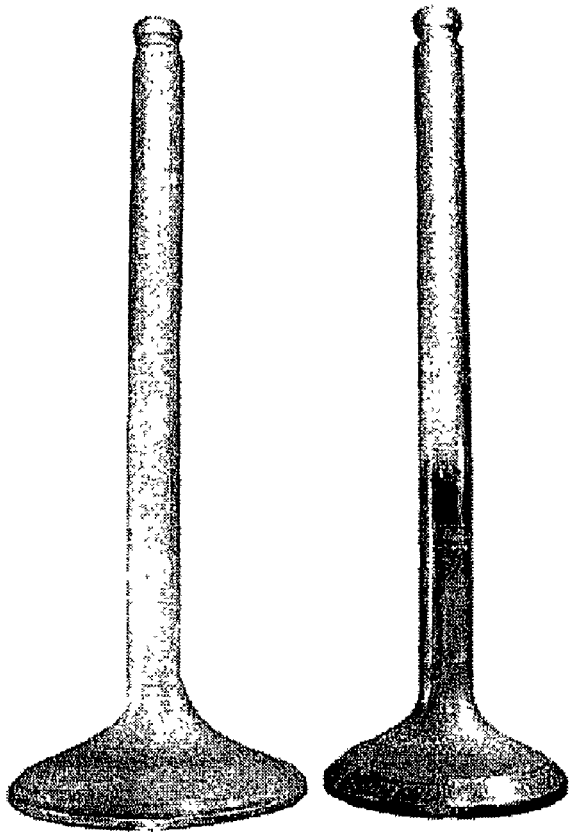
FIG. 4 is a picture showing the results of a durability test performed on an exhaust valve and an intake valve in accordance with the present invention.

The durability test was performed by installing the exhaust valve and the intake valve in the 3.1 liter GM engine and operating the engine 400 hours. After 400 hours, the exhaust valve and intake valve were removed from the engine and visually inspected for wear. FIG. 4 shows that both the exhaust valve (left valve in FIG. 4) and the intake valve (right valve in FIG. 4) exhibited no signs of corrosion and galling.

EXAMPLE 2

The hardness and elastic modulus of a TDC plated exhaust valve prepared in accordance with Example 1 was compared to the hardness and elastic modulus of an exhaust valve plated with a conventional hard chromium coating. The hardness and elastic modulus was determined using an MTS NANO INDENTER XPW, which was commercially available from MTS Systems Corporation, of Eden Prairie, Minn.

Figure 5:
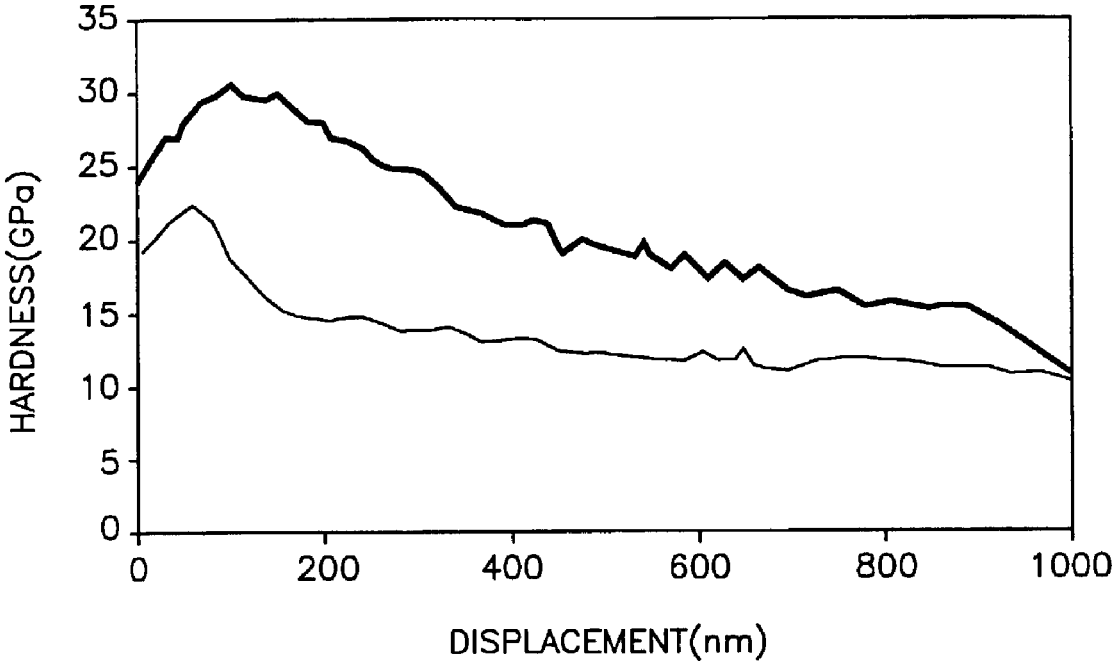
FIG. 5 is a graph showing the average hardness as a function of displacement for a thin, dense chromium plated valve in accordance with the present invention.

FIG. 5 is a graph showing the average hardness as a function of displacement for the TDC plated valve measured by the NANO INDENTER. FIG. 5 indicates that the average hardness as a function of displacement for the TDC plated valve is bi-modal on a nano-scale. By bi-modal it is meant that the TDC coated valve exhibited two distinct hardness values on a nano-scale. It is believed the thin, dense chromium plated on the exhaust valve comprises distinct nano-scale regions that have a first average hardness and a second average hardness, respectively. The first average hardness was about 72, based on a Rockwell C scale, while the second average hardness was about 92, based on a Rockwell C scale.

Figure 6:
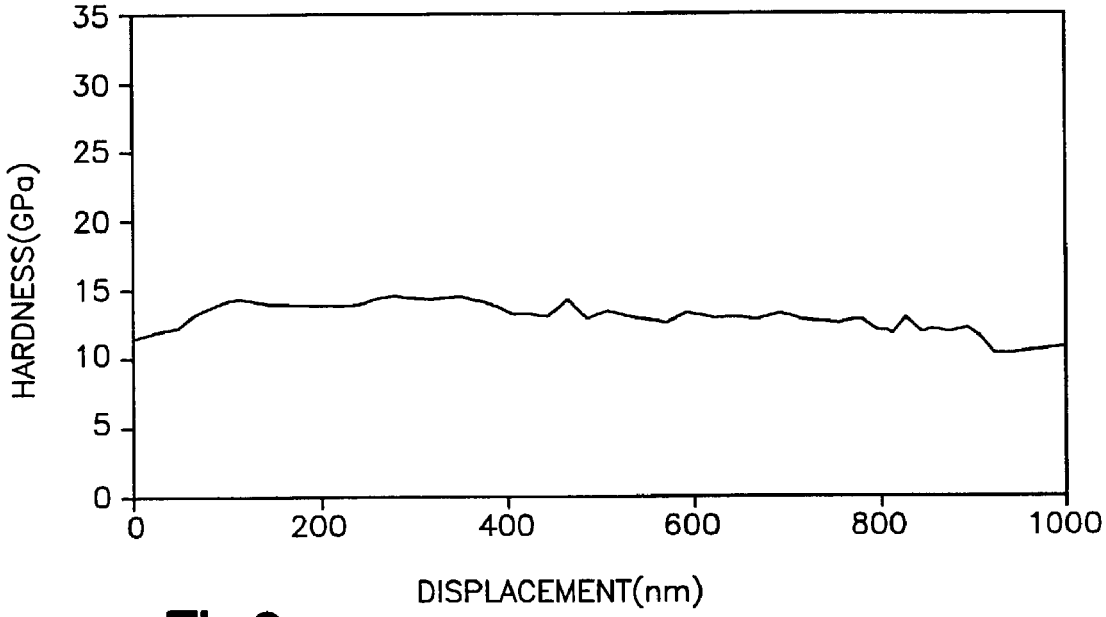
FIG. 6 is a graph showing the average hardness as a function of displacement for a conventional, hard chromium plated valve.

FIG. 6 is a graph showing the average hardness as a function of displacement for the hard chromium coated valve measured by the NANO INDENTER. FIG. 6 indicates that the hard chromium coated valve was not bi-modal on a nano-scale. The average hardness of the conventional hard chromium coated valve was about 72, based on a Rockwell C scale.

Figure 7:
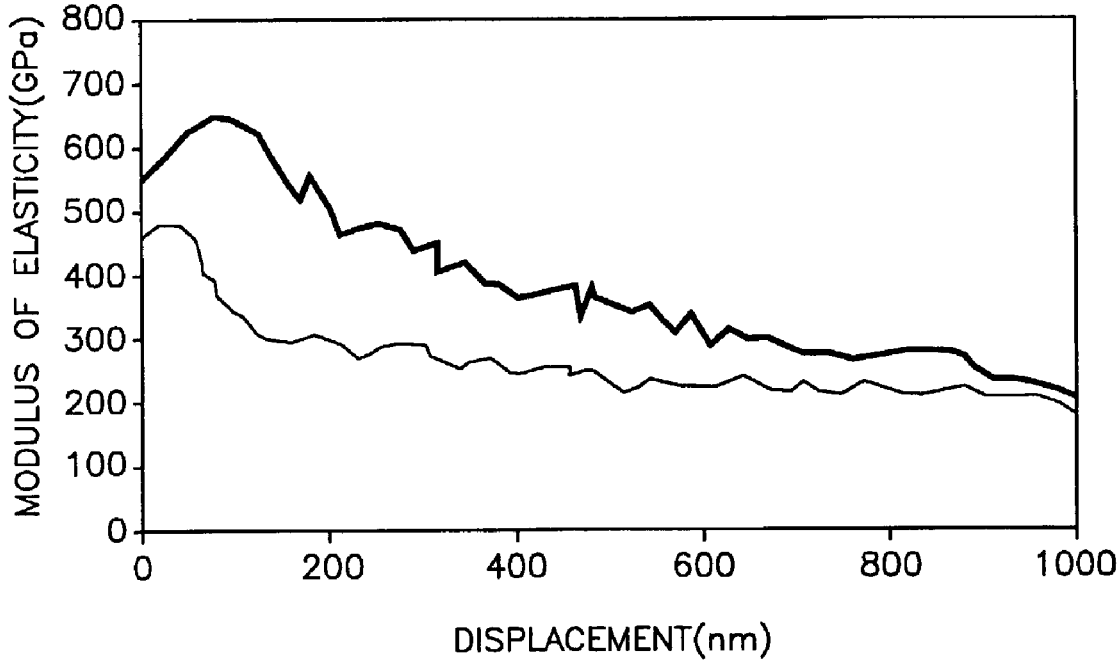
FIG. 7 is a graph showing the average elastic modulus as a function of displacement for a thin, dense chromium plated valve in accordance with the present invention.

FIG. 7 is a graph showing the average elastic modulus as a function of displacement of the TDC coated valve measured by the NANO INDENTER. FIG. 7 indicates that the average elastic modulus of the TDC coated valve, like the average hardness, was bi-modal on a nano-scale. The first average elastic modulus was about 290 GPa (42 MSI) while the second average elastic modulus was about 690 GPa (101 MSI).

Figure 8:
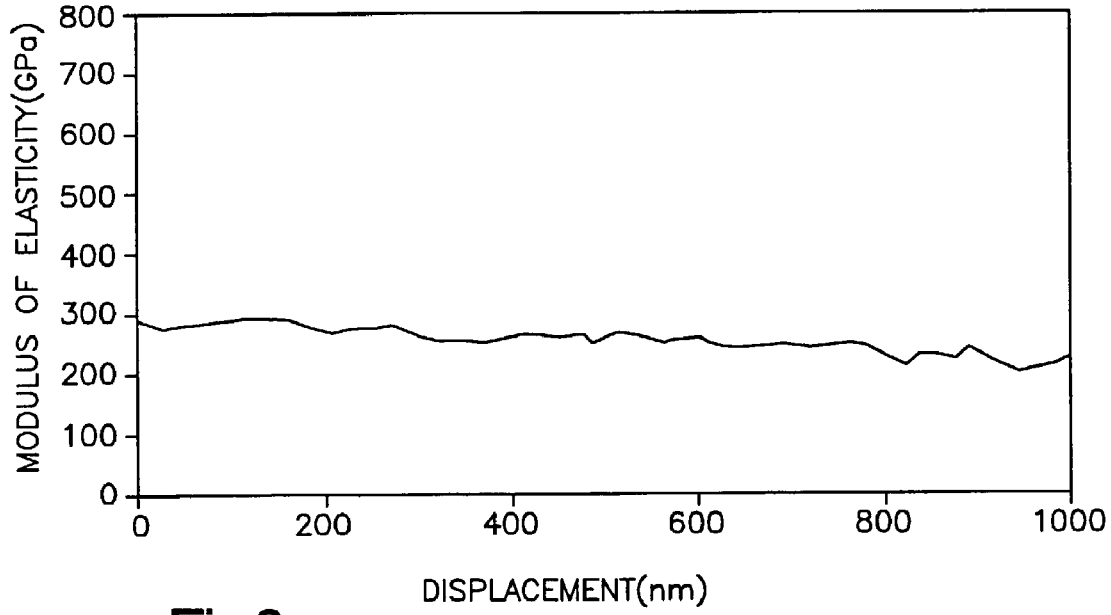
FIG. 8 is a graph showing the average elastic modulus as a function of displacement for a conventional, hard chromium plated valve.

FIG. 8 is a graph showing the average elastic modulus as a function of displacement of the hard chromium coated valve measured by the NANO INDENTER. FIG. 8 indicates that the average elastic modulus was not bi-modal on a nano-scale. The average elastic modulus was about 280 GPa (41 MSI).

EXAMPLE 3

The resistance to rust of a slug of 1541 carbon steel (12.77 mm diameter×12.7 mm length) plated with a coating of thin, dense chromium using the TDC-1 process was compared to the resistance to rust of an uncoated slug of 1541 steel.

The plated slugs were subjected to the ASTM D1748 30 day relative humidity test. After 30 days in a 90% relative humidity at 100° F., the slug plated with thin, dense chromium upon visual inspection showed no signs of rust. The absence of rust is advantageous because the exhaust and intake valves can be formed without a coating of a rust inhibitor, which conventional intake and exhaust valves must be coated with.

In contrast, after 3 days in a 90% relative humidity at 100° F., the uncoated slug upon visual inspection showed signs of rust. The presence of rust on the uncoated slug of 1541 carbon steel indicates that areas of a valve of 1541 carbon steel that are not protected with a chromium coating must be coated with a rust inhibitor.

EXAMPLE 4

The resistance to oxidation of a TDC plated slug of 1541 carbon steel prepared in accordance with the slug in Example 3 was compared to the resistance to oxidation of an uncoated slug of 1541 steel.

The TDC plated slug and the uncoated slug were weighed and then placed in a 760° C. (1400° F.) oven with an air atmosphere.

After being heated in the oven for 100 hours, the TDC plated slug showed no weight loss, which is an indication that the TDC plated slug was not oxidized during heating. Visual inspection of the slug at 100× and 400× magnification also failed to reveal any evidence of oxidation. The absence of oxidation of the slug indicates that a valve of 1541 carbon steel plated with a thin, dense chromium coating can be subjected to temperatures up to about 760° C. without being oxidized.

In contrast, the uncoated slug experienced an about 25% weight loss after being heated in the oven, which is an indication that the slug was oxidized during heating. Visual inspection of the slug at 100× magnification and 400× magnification also showed evidence of oxidation.

EXAMPLE 5

The resistance to sulfadation of a slug of INCO 751 steel (12.77 mm diameter×12.7 mm length) plated with a coating of thin, dense chromium using the TDC-1 process was compared to the resistance to sulfadation of a slug of INCO 751 steel plated with a conventional hard chromium coating.

The TDC plated slug and the hard chromium plated slug were weighed, covered with sulfur powder, and heated to a temperature of 871° C. (1600° F.) in an oven with an air atmosphere. After being heated in the oven for 100 hours, the TDC plated slug showed no weight loss, which is an indication that the slug is resistant to sulfadation. Visual inspection of the slug at 50× magnification and 400× magnification showed minimal evidence of sulfadation.

In contrast, after 80 hours in the oven at 871° C., the hard chromium plated slug was completely dissolved so that the hard chromium plated slug was no longer present. It is believed that the micro-cracks in the conventional hard chromium allows the INCO 751 steel of the slug to undergo sulfadation and therefore completely dissolve.

EXAMPLE 6

The residual stress of a TDC coating plated on an exhaust valve prepared in accordance with Example 1 was compared to the residual stress of a conventional hard chromium coating plated on an exhaust valve.

Analysis by X-ray diffraction revealed that the TDC coating was subjected to compressive stress less than −69 megapascals (MPa) (10,000 pounds/inches$^2$). The compressive residual stress of the TDC coating provided the TDC coating with a high cycle fatigue life about 7.5 times longer than the 1541 carbon steel.

In contrast, analysis by X-ray diffraction revealed that the conventional hard coating was subjected to tensile stress greater than 69 MPa (10 KSI). The tensile residual stress of the conventional hard coating provided the conventional hard coating with a high cycle fatigue life about 10 times less than the base 1541 carbon steel.

Advantages of the present invention should now be apparent. The present invention provides a micro-nodular, crack-free, thin, dense chromium coating on an engine valve for an internal combustion engine. A valve plated with a thin, dense chromium coating has a longer life, better wear resistance, and better resistance to corrosion than a valve plated with a conventional hard chromium coating. Moreover, a valve can be completely covered with a thin, dense chromium coating as opposed to only covering the valve with a conventional hard chromium coating because the thin, dense chromium coating does not lower the fatigue life of the base material of the valve. Moreover, a valve that is completely covered with the thin, dense chromium coating need not employ a rust inhibitor and may be plated using barrel type platers as opposed to using only rack and finger type platers.

From the above description of the invention, those skilled in the art will perceive improvements, changes, and modifications. Such improvements, changes and modifications within the skill of the art are intended to be covered by the appended claims.

What is claimed is:

1. A valve for use in an internal combustion engine, said valve being an intake or exhaust valve, said valve comprising a head portion, a tip portion, and a stem portion that interconnects said head portion and tip portion, the head portion, the stem portion and the tip portion of said valve being substantially coated with a thin, dense chromium coating, the thin, dense chromium coating being substantially crack-free, and the valve having a surface finish less than about 15 $\mu$ inches as measured in accordance with ANSI B46.1.

2. The valve of claim 1 wherein the thin, dense chromium coating has a hardness and an elastic modulus that are bi-modal on a nano-scale.

3. A valve for use in an internal combustion engine, said valve being an intake or exhaust valve, said valve comprising a head portion, a tip portion, and a stem portion that interconnects said head portion and said tip portion, said valve including a chromium layer that substantially covers said head portion, tip portion and stem portion of said valve, said chromium layer complying with SAE AMS 2438a and being substantially crack-free and the valve having a surface finish less than about 15 $\mu$inches as measured in accordance with ANSI B46.1.

4. The valve of claim 3 wherein the chromium layer has a hardness and an elastic modulus that are bi-modal on a nano-scale.

* * * * *